US005593545A

United States Patent [19]

Rugowski et al.

[11] Patent Number: 5,593,545

[45] Date of Patent: Jan. 14, 1997

[54] METHOD FOR MAKING UNCREPED THROUGHDRIED TISSUE PRODUCTS WITHOUT AN OPEN DRAW

[75] Inventors: James S. Rugowski; Michael J. Rekoske, both of Appleton, Wis.; Philip S. Lin, Tulsa, Okla.; Ronald F. Gropp, St. Catharines, Canada; Paul A. B. L. M. Arnold, Nancy, France

[73] Assignee: Kimberly-Clark Corporation, Neenah, Wis.

[21] Appl. No.: 384,306

[22] Filed: Feb. 6, 1995

[51] Int. Cl.[6] ..... D21H 25/04

[52] U.S. Cl. ..... 162/207; 162/118

[58] Field of Search ..... 162/116, 118, 162/207, 283, 290, 359.1, 358.1; 34/414, 444, 452, 453, 454, 458, 114, 116, 466; 242/370, 397.5, 397

[56] References Cited

U.S. PATENT DOCUMENTS

| | | | |
|---|---|---|---|
| 1,585,977 | 5/1926 | Hall | 162/283 |
| 2,209,758 | 7/1940 | Berry | 162/290 |
| 3,806,406 | 4/1974 | Ely | 162/290 |
| 4,081,320 | 3/1978 | Wahren et al. | 162/205 |
| 4,087,319 | 5/1978 | Linkletter | 162/283 |
| 4,356,059 | 10/1982 | Hostetler | 162/207 |
| 4,359,827 | 11/1982 | Thomas | 34/16 |
| 4,440,597 | 4/1984 | Wells et al. | 162/111 |
| 4,976,821 | 12/1990 | Laapotti | 162/360.1 |
| 5,048,589 | 9/1991 | Cook et al. | 162/109 |

FOREIGN PATENT DOCUMENTS

| | | | |
|---|---|---|---|
| 753325 | 7/1956 | United Kingdom | 162/207 |

*Primary Examiner*—William Beisner
*Attorney, Agent, or Firm*—Gregory E. Croft

[57] ABSTRACT

A method for making uncreped throughdried tissues is disclosed in which the dried tissue sheet is fully supported by a fabric up to the reel. This method eliminates the open draw between the throughdryer and the reel and thereby eliminates sheet breaks normally associated with such open draws. In addition, the machine direction strength of the sheet can be reduced since the added strength is not needed to traverse the open draw normally present in current processes. Reducing the MD strength in turn enables the production of more square, less stiff sheet, which improves the tactile properties of the product.

12 Claims, 6 Drawing Sheets

METHOD FOR MAKING UNCREPED THROUGHDRIED TISSUE PRODUCTS WITHOUT AN OPEN DRAW

BACKGROUND OF THE INVENTION

In the manufacture of tissue products such as facial tissues, bath tissues and paper towels, the tissue basesheets are generally produced by depositing an aqueous suspension of papermaking fibers onto a forming fabric, dewatering the suspension to form a web, drying the web, and winding the dried web into a roll for subsequent conversion into a particular product form. During manufacturing, most tissue webs are adhered to a steam-heated Yankee dryer and thereafter dislodged from the surface of the Yankee by contact with a doctor blade (creping) prior to converting to improve the softness and stretch of the sheet. More recently, soft uncreped throughdried tissue sheets have been disclosed in which the softness and stretch are built into the sheet by other processing methods.

However, in all such processes, the final sheet traverses an "open draw" before being wound into rolls, meaning that the dried sheet is momentarily unsupported before being wound. In the case of creped sheets, the sheet is dislodged from the creping cylinder and passed unsupported from the creping cylinder to the reel. For uncreped throughdried sheets, the sheet leaves the throughdrying fabric, or a subsequent transfer fabric, and also passes unsupported to the reel. As those in the tissue manufacturing business know, these unsupported runs or open draws are a source of sheet breaks and production delay time. To compensate, the tissue sheets are designed to have high machine direction strengths in order to remain intact during manufacturing. However, such high strengths are often counterproductive in terms of softness and are not desirable to the end user of the product.

Therefore, if open draws in tissue manufacturing could be eliminated, tissues could be made more efficiently from a waste-and-delay standpoint and the machine direction strength of the final product could be reduced to levels dictated solely by product requirements rather than manufacturing requirements.

SUMMARY OF THE INVENTION

It has now been discovered that in the manufacture of uncreped throughdried tissue sheets, the open draw between the throughdryer and the reel can be eliminated using an appropriate combination of dry end transfer fabrics and/or other transfer devices. In so doing, tissue sheets having much lower machine direction strengths can be made, thereby providing a means for making tissue sheets that are softer and more "square" in terms of the machine direction and cross-machine direction tensile strengths.

Hence in one aspect, the invention resides in a method for making an uncreped throughdried tissue comprising depositing an aqueous suspension of papermaking fibers onto a forming fabric to form a wet web, transferring the wet web to a throughdrying fabric, throughdrying the web to form a tissue sheet, and transferring the tissue sheet to a reel such that the sheet does not traverse an open draw while being wound onto the reel in the winding nip formed between the reel and a reel drum. Avoidance of the open draw can be achieved either by direct transfer of the tissue sheet from the throughdrying fabric to the reel drum or by an intermediate transfer to one or more dry end transfer fabrics. This method is particularly advantageous at high machine speeds (about 2000 or about 3000 feet per minute or greater) where a relatively high MD tensile strength is otherwise necessary for the sheet to pass to the reel without periodically breaking.

Hence in another aspect, the invention resides in the foregoing method wherein the tissue sheet is: (a) transferred from the throughdrying fabric to a first dry end transfer fabric using a vacuum roll; (b) carried between the first dry end transfer fabric and the top side of a second dry end transfer fabric having a relatively high degree of air permeability (about 200 cubic feet per minute per square foot or greater), the underside of which partially wraps around the reel drum; (c) transferred to the top side the second dry end transfer fabric and maintained thereon by air pressure created by an air foil positioned on the underside of the second dry end transfer fabric; and (d) wound onto the reel. More specifically, the air permeability of the second dry end transfer fabric can be from about 200 to about 500 cubic feet per minute per square foot, still more specifically from about 300 to about 400 cubic feet per minute per square foot. Air permeability, which is the air flow through a fabric while maintaining a differential air pressure of 0.5 inch across the fabric, is described in ASTM test method D737.

In a further aspect, the invention resides in the foregoing method wherein the tissue sheet is: (a) transferred from the throughdrying fabric to a first dry end transfer fabric using a vacuum roll; (b) carried between the first dry end transfer fabric and the top side of a second dry end transfer fabric having an air permeability of about 100 cubic feet per minute per square foot or less, the underside of which partially wraps around the reel drum; (c) transferred to the top side the second dry end transfer fabric; and (d) wound onto the reel. More specifically, the air permeability of the second dry end transfer fabric can be from 0 to about 100 cubic feet per minute per square foot, more specifically from about 25 to about 100 cubic feet per minute per square foot, still more specifically from about 50 to about 100 cubic feet per minute per square foot.

In another aspect, the invention resides in a papermaking machine for continuously making uncreped throughdried paper webs comprising: (a) a headbox for depositing an aqueous suspension of papermaking fibers onto a forming wire; (b) a continuous forming fabric for receiving the aqueous suspension of papermaking fibers to form a wet web; (c) a continuous transfer fabric positioned adjacent to the forming fabric to enable the wet web to transfer from the forming fabric to the transfer fabric; (d) means for effecting transfer of the wet web from the forming fabric to the transfer fabric; (e) a rotatable throughdrying cylinder for drying the wet web; (f) a continuous throughdrying fabric which at least partially wraps around the throughdryer and is positioned adjacent to the transfer fabric to enable transfer of the wet web from the transfer fabric to the throughdryer fabric; (g) means for effecting transfer of the wet web from the transfer fabric to the throughdrying fabric; (h) a rotatable reel for winding up the dried web; (i) a reel drum adjacent to the reel for assisting in winding up the dried web; and (j) means for transferring the dried web from the throughdrying fabric to the reel without an open draw.

In yet a further aspect, the invention resides in the foregoing paper machine wherein the means for transferring the web from the throughdrying fabric to the reel comprises: (a) a continuous first dry end transfer fabric positioned adjacent to the throughdryer fabric to enable transfer of the dried web to the first dry-end transfer fabric; (b) a continuous loop of a second dry-end transfer fabric positioned adjacent to the first dry-end transfer fabric such that the dried web is sandwiched between the first and second dry-end transfer fabrics, wherein said second dry-end transfer fabric loops around the reel drum and has an air permeability of about 200 cubic feet per minute per square foot or greater; and (c) an air foil positioned within the loop of the second dry end transfer fabric and adjacent to the second dry-end transfer fabric which creates air pressure to maintain the dried web in contact with the second dry-end transfer fabric.

In still a further aspect, the invention resides in the foregoing papermaking machine wherein the means for transferring the web from the throughdrying fabric to the reel comprises: (a) a continuous first dry-end transfer fabric positioned adjacent to the throughdryer fabric to enable transfer of the dried web to the first dry-end transfer fabric; (b) a continuous loop of a second dry-end transfer fabric positioned adjacent to the first dry-end transfer fabric such that the dried web is sandwiched between the first and second dry-end transfer fabrics, wherein said second dry-end transfer fabric loops around the reel drum and has an air permeability of about 100 cubic feet per minute per square foot or less.

In another aspect, the invention resides in the foregoing papermaking machine wherein the means for transferring the web from the throughdryer fabric to the reel comprises the reel drum being positioned adjacent to the throughdryer fabric sufficiently close to enable the dried web to be transferred to the reel drum.

In yet another aspect, the invention resides in the foregoing papermaching machine wherein the means for transferring the web from the throughdryer fabric to the reel comprises a vacuum drum positioned adjacent to the throughdrying fabric sufficiently close to enable the dried web to be transferred to the vacuum drum, said vacuum drum being positioned adjacent to the reel drum to enable the dried web to transfer from the vaccuum drum to the reel drum.

These and other aspects of the invention will be described in greater detail in reference to the drawing.

DETAILED DESCRIPTION OF THE INVENTION

In describing the various figures herein, the same reference numbers are used throughout to describe the same apparatus. To avoid redundancy, detailed descriptions of much of the apparatus described in FIG. 1 is not repeated in the descriptions of subsequent figures, although such apparatus is labelled with the same reference numbers.

Figure 1:
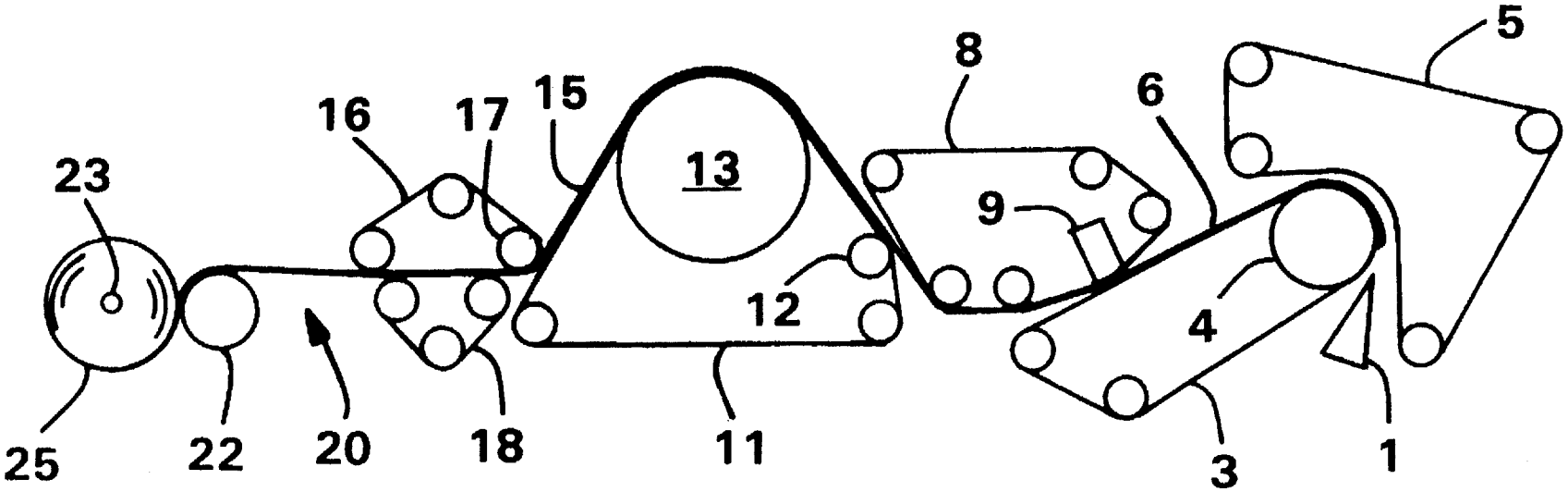
FIG. 1 (PRIOR ART)
FIG. 1 is a schematic flow diagram illustrating a method for making uncreped throughdried tissue sheets in a manner representative of the prior art using an open draw prior to the reel.

Referring first to FIG. 1, shown is a schematic flow diagram of a representative throughdrying process for making uncreped throughdried tissues. Shown is the headbox 1 which deposits an aqueous suspension of papermaking fibers onto inner forming fabric 3 as it traverses the forming roll 4. Outer forming fabric 5 serves to contain the web while it passes over the forming roll and sheds some of the water. The wet web 6 is then transferred from the inner forming fabric to a wet end transfer fabric 8 with the aid of a vacuum transfer shoe 9. This transfer is preferably carried out with the transfer fabric travelling at a slower speed than the forming fabric (rush transfer) to impart stretch into the final tissue sheet. The wet web is then transferred to the throughdrying fabric 11 with the assistance of a vacuum transfer roll 12. The throughdrying fabric carries the web over the throughdryer 13, blows hot air through the web to dry it while preserving bulk. There can be more than one throughdryer in series (not shown), depending on the speed and the dryer capacity. The dried tissue sheet 15 is then transferred to a first dry end transfer fabric 16 with the aid of vacuum transfer roll 17. The tissue sheet shortly after transfer is sandwiched between the first dry end transfer fabric and a second dry end transfer fabric 18 to positively control the sheet path. The tissue sheet leaves the transfer fabrics and traverses an open draw designated by reference number 20, at which point the sheet is unsupported. The sheet then passes through the winding nip between the reel drum 22 and the reel 23 and is wound into a roll of tissue 25 for subsequent converting, such as slitting, cutting, folding and packaging.

Figure 2:
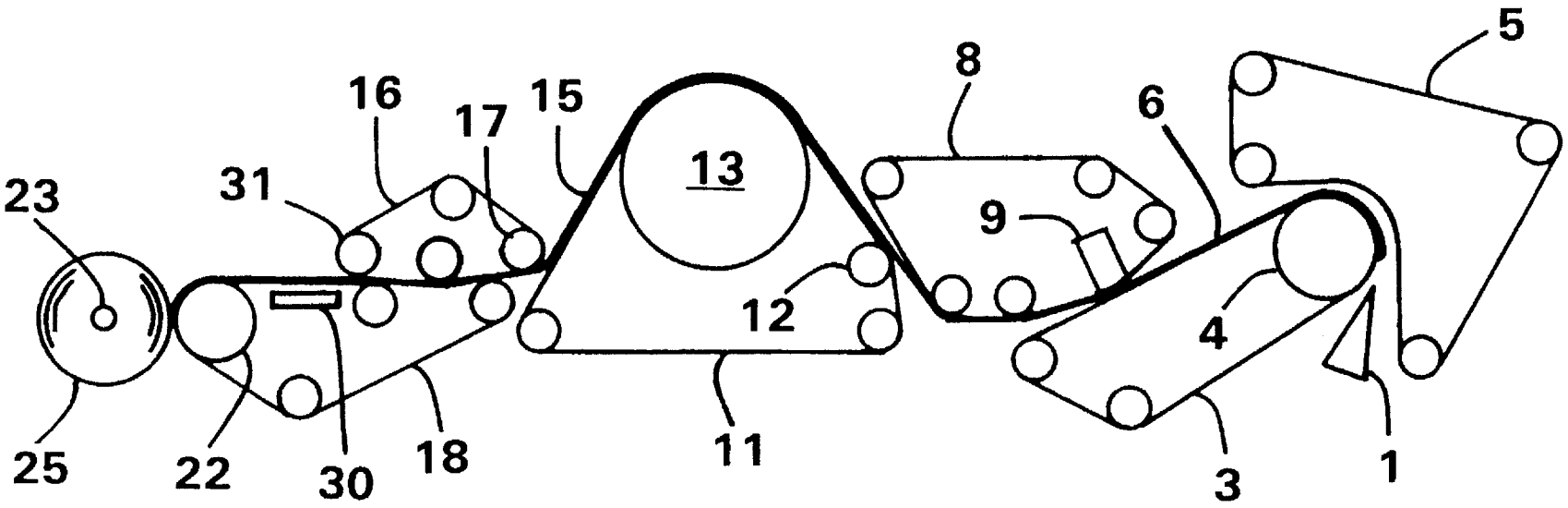
FIG. 2 is a schematic flow diagram of a method for making an uncreped throughdried tissue sheet in accordance with this invention utilizing an extended fabric having high permeability.

FIG. 2 is a schematic flow diagram of a process in accordance with this invention, in which the open draw leading to the reel is eliminated. The front end of the process is the same as shown in FIG. 1. As the tissue sheet leaves the throughdryer fabric, it is transferred to a first dry end transfer fabric 16 with the aid of a vacuum transfer roll 17. Suitable fabrics for use as the first dry end transfer fabric 16 include, without limitation, a wide variety of fabrics such as Asten 934, Asten 939, Albany 59M, Albany Duotex DD207, Lindsay 543 and the like. The tissue sheet is then compressed between the first dry end transfer fabric and a second dry end transfer fabric 18, which has a greater air permeability than that of the first dry end transfer fabric and which wraps around the reel drum 22. Suitable second dry end transfer fabrics include, without limitation, Asten 960 (air permeability of about 300–400), Appleton Mills style Q53F (air permeability of about 400), Appleton Mills style Q53KY (air permeability of about 200), Albany Duotex A81 and Appleton Mills style HC200 (air permeability of about 200). Because of the air flow through the lower fabric caused by roll 31, the sheet transfers to the second dry end transfer fabric 18. It is retained on the top surface of the second dry end transfer fabric by air pressure generated by the presence of an air foil 30 on the underside of the fabric. The tissue sheet is then carried to the winding nip formed between the reel drum and the reel 23 and wound into a roll 25.

Figure 3:
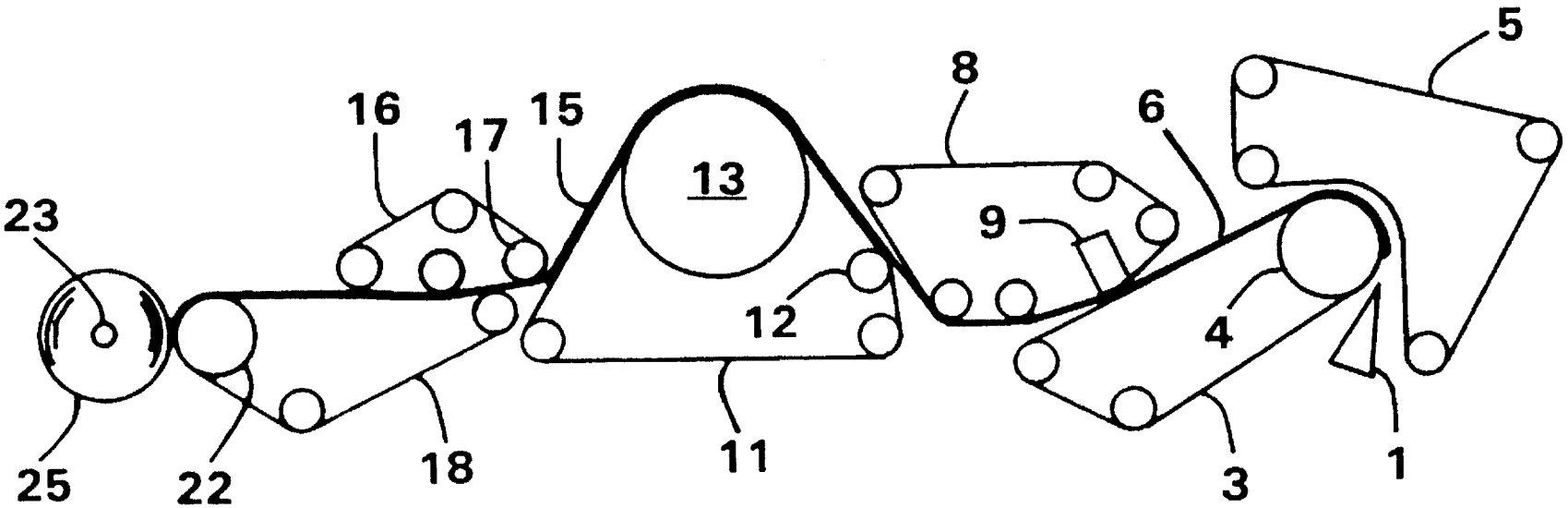
FIG. 3 is a schematic flow diagram of a method for making an uncreped throughdried tissue sheet in accordance with this invention utilizing an extended fabric having low permeability.

FIG. 3 represents another embodiment of the method of this invention, similar to that illustrated in FIG. 2, but in which the permeability of the second transfer fabric is much lower than the corresponding fabric used for the method of FIG. 2. By lowering the permeability of the second dry end transfer fabric, the need for an air foil is eliminated because with the lower permeability of the second fabric, the sheet tends to naturally adhere to that fabric. At the point of separation the sheet follows the lower permeability fabric due to vacuum action. No air is pumped through the fabric by the various rolls an no foils are required. Suitable low air permeability fabrics for this embodiment include, without limitation, Asten 960 dryer fabric (air permeability of about 50–100), COFPA Mononap NP 50 dryer felt (air permeability of about 50) and Appleton Mills dryer felt style H53FH (air permeability of about 75).

Figure 4:
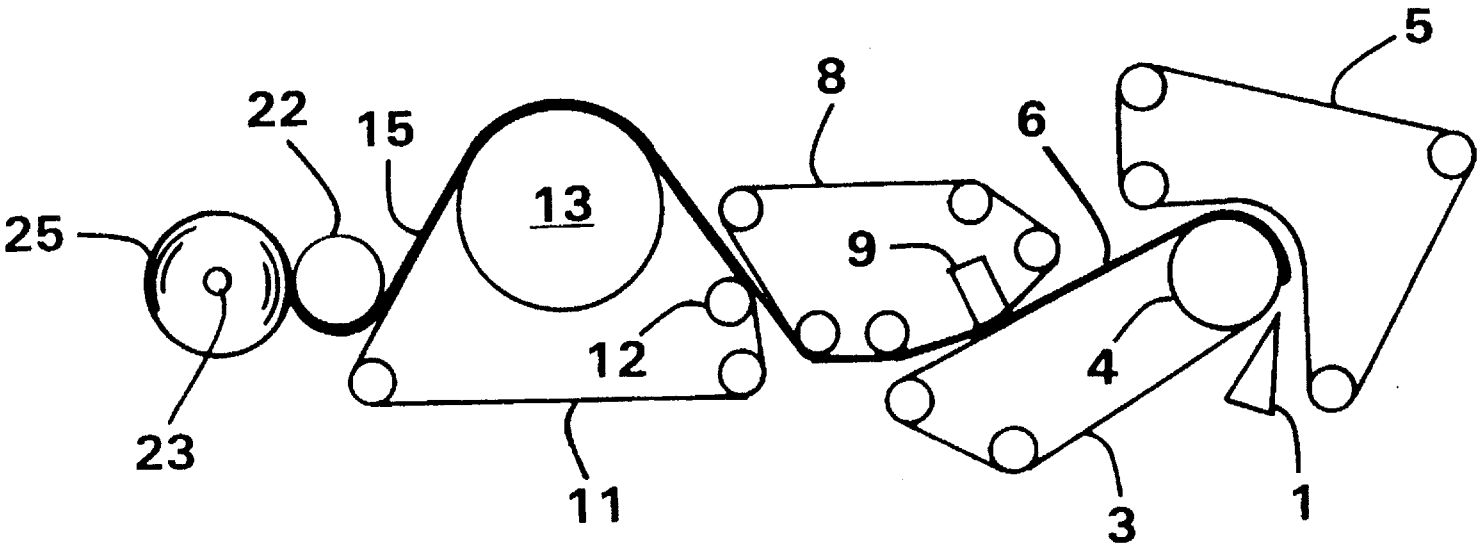
FIG. 4 is a schematic flow diagram of a method for making an uncreped throughdried tissue sheet in accordance with this invention utilizing a single drum to wind up the sheet directly from the throughdrying fabric.

FIG. 4 is a schematic flow diagram of another method in accordance with this invention in which the tissue sheet 15 is transferred to the reel drum 22 directly from the throughdrying fabric 11. This is accomplished using vacuum suction from within the reel drum and/or pressurized air. The tissue sheet is then wound into a roll 25 on reel 23. The advantage of this method compared to those of FIGS. 2 and 3 is the elimination of the dry end transfer fabrics.

Figure 5:
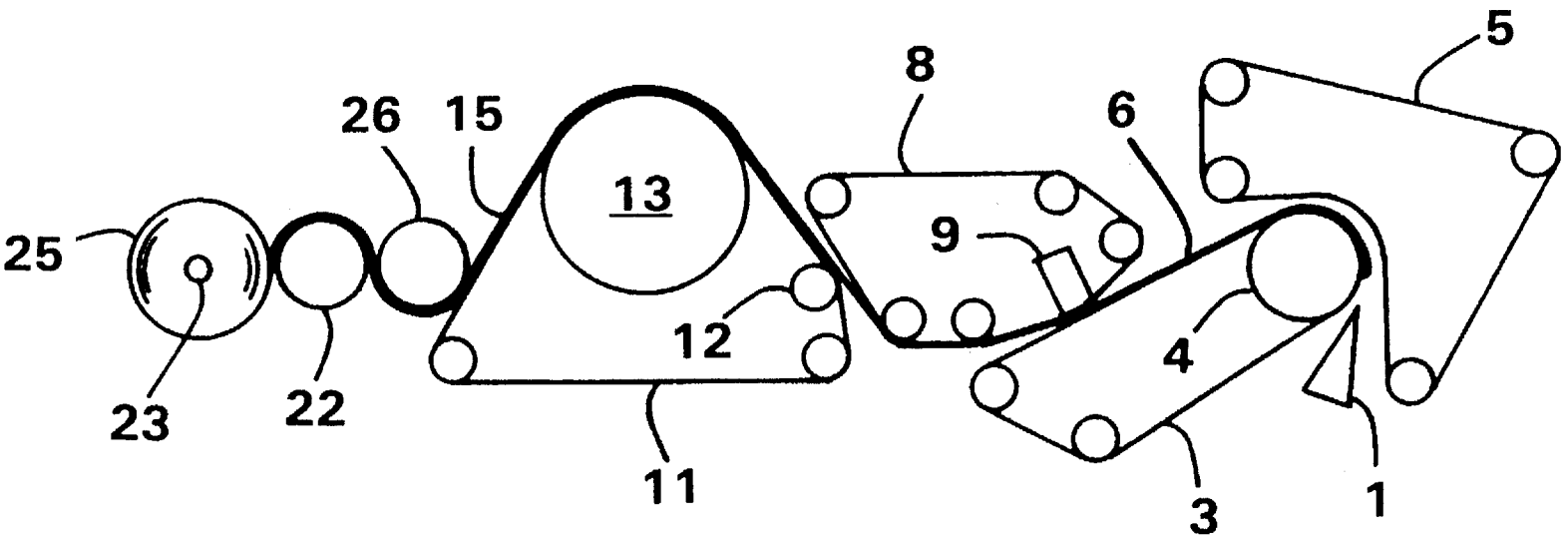
FIG. 5 is a schematic flow diagram of a method for making an uncreped throughdried tissue sheet in accordance with this invention utilizing two drums to wind up the sheet directly from the throughdrying fabric.

FIG. 5 is a schematic flow diagram of an alternative method in accordance with this invention similar to that illustrated in FIG. 4, but using a vacuum drum 26 to transfer the tissue sheet 15 from the throughdrying fabric 11 and pass it on to the reel drum 22 for winding into a roll 25 on reel 23. The nip between rolls 22 and 26 can be configured for calendering.

Figure 6:
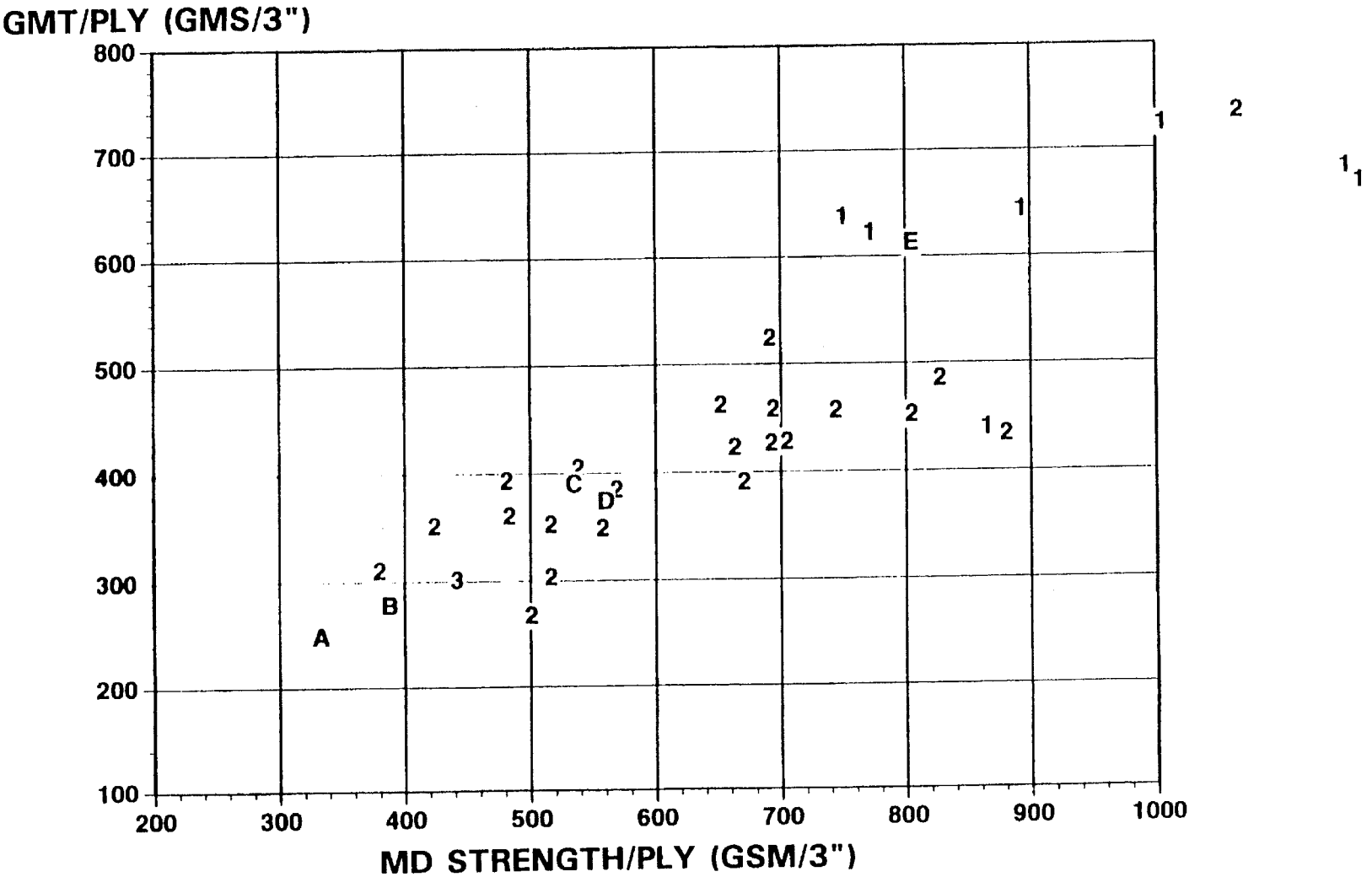
FIG. 6 is a plot showing geometric mean tensile strength (GMT) per ply versus the MD tensile strength per ply for a variety of commercial facial tissues, bathroom tissues and towels, as well as several examples produced by the method of this invention.

FIG. 6 is a plot showing the geometric mean tensile strength per ply versus MD tensile strength per ply (expressed as grams-force per 3 inches of sample width) for a variety of commercial facial tissues, bathroom tissues and towels, as well as several examples produced by this invention. Numbers "1", "2" and "3" denote commercially available one, two and three-ply facial, bath and towel products. Letters "A–E" refer to tissue products made in Example 1. Data points A and B specifically demonstrate the ability of this invention to consistently produce and reel up tissue webs of low strength. While other low-strength tissues exist, it is commonly known within the industry that their production typically involves reduced machine speed and efficiency. This invention allows the production of such tissues at high speed (3000 feet per minute or greater) with little, or no, loss in efficiency due to dry-end sheet breaks.

EXAMPLES

Example 1.

In order to further illustrate this invention, several rolls of low strength uncreped throughdried tissue were produced on a commercial tissue machine using the method substantially as illustrated in FIG. 1. More specifically, three-layered single-ply bath tissue was made in which the outer layers comprised dispersed, debonded Aracruz eucalyptus fibers and the center layer comprised refined northern softwood kraft fibers, NB-50.

Prior to formation, the eucalyptus fibers were pulped for 15 minutes at 10 percent consistency and dewatered to 30–40 percent consistency. The pulp was then fed to a Maule shaft disperser operated at 194(F. (90(C.) with a power input of 3.2 horsepower-days per ton (2.6 kilowatt-days per tonne). Subsequent to dispersing, a softening agent (Berocell 596) was added to the pulp in the amount of 15 pounds of Berocell per tonne of dry fiber (0.75 weight percent).

The softwood fibers were pulped for 30 minutes at 7 percent consistency and diluted to 3.5 percent consistency after pulping, while the dispersed, debonded eucalyptus fibers were diluted to 3.5 percent consistency. The overall layered sheet weight was split 30%/40%/30% among the dispersed eucalyptus/refined softwood/dispersed eucalyptus layers. The center layer was refined to levels required to achieve target strength values, while the outer layers provided the surface softness and bulk. Parez 631NC was added to the center layer at 11 pounds (5.0 kilograms) per tonne of pulp based on the center layer.

A three-layer headbox was used to form the wet web with the refined northern softwood kraft stock in the center layer of the headbox to produce a single center layer for the three-layered product described. Turbulence-generating inserts recessed about 3 inches (75 millimeters) from the slice and layer dividers extending about 6 inches (150 millimeters) beyond the slice were employed. The net slice opening was about 1.22 inch (31 millimeters) with water flow in the center layer approximately two times that in each outer layer. The consistency of the stock fed to the headbox was about 0.1 weight percent.

The resulting three-layered sheet was formed on a twin-wire, suction form roll, former with forming fabrics (5 and 3 in FIG. 1) being Asten 866 and Asten 856 fabrics, respectively. The speed of the forming fabrics was 15.2 meters per second. The newly-formed web was then dewatered to a consistency of about 20–27 percent using vacuum suction from below the forming fabric before being transferred to the transfer fabric, which was travelling at 11.7 meters per second (30% rush transfer). The transfer fabric was an Albany Duotex R-12. A vacuum shoe pulling about 6–15 inches (150–380 millimeters) of mercury vacuum was used to transfer the web to the transfer fabric.

The web was then transferred to a throughdrying fabric (Lindsay Wire T-216-3). The throughdrying fabric was travelling at a speed of about 11.7 meters per second (about 2200 feet per minute). The web was carried over a Honeycomb throughdryer operating at a temperature of about 350° F.(175° C.) and dried to final dryness of about 98 percent consistency.

The web was then taken to the reel with no opportunity for open draws according to the high permeability fabric scheme illustrated in FIG. 2. The first dry end transfer fabric was an Asten 960 while the second dry end transfer fabric was an Albany Duotex A81. The second dry end transfer fabric had an air permeability of 410 cubic feet per minute per square foot at 0.5 inch of water pressure differential. A foil was required under the second dry end transfer fabric at the point of separation of the first and second dry end transfer fabrics. This foil created a low pressure area under the second dry end transfer fabric and caused the sheet to follow this fabric.

Several low strength uncreped throughdried webs were produced at these conditions. All were of approximately 30 grams per square meter in basis weight. Strength parameters were as shown in Table 1.

TABLE 1

| | MD Tensile | MD Stretch | CD Tensile | CD Stretch | GMT |
|---|---|---|---|---|---|
| 1-A | 333 | 15 | 185 | 8.9 | 248 |
| 1-B | 388 | 16 | 199 | 9.8 | 277 |
| 1-C | 535 | 18 | 289 | 12.6 | 389 |
| 1-D | 560 | 18.5 | 249 | 9.9 | 373 |
| 1-E | 805 | 20 | 466 | 10.9 | 612 |

This data is represented as points A–E in FIG. 6. It illustrates the ability of this invention to commercially produce and wind tissue webs of low strength.

It will be appreciated that the foregoing examples, given for purposes of illustration, are not to be construed as limiting the scope of this invention, which is defined by the following claims and all equivalents thereto.

We claim:

1. A method for making an uncreped throughdried tissue comprising depositing an aqueous suspension of papermaking fibers onto a forming fabric to form a wet web, transferring the wet web to a throughdrying fabric, throughdrying the web to form a tissue sheet, and transferring the tissue sheet to a reel such that the sheet does not traverse an open draw while being wound onto the reel in the winding nip formed between the reel and a reel drum wherein the tissue sheet is: (a) transferred from the throughdrying fabric to a first dry end transfer fabric using a vacuum roll; (b) carried between the first dry end transfer fabric and the top side of a second dry end transfer fabric, the underside of which partially wraps around the reel drum; (c) transferred to the top side of the second dry end transfer fabric and maintained thereon by air pressure created by an air foil positioned on the underside of the second dry end transfer fabric; and (d) wound onto the reel.

2. The method of claim 1 wherein the air permeability of the second dry end transfer fabric is about 200 cubic feet per minute per square foot or greater.

3. The method of claim 1 wherein the air permeability of the second dry end transfer fabric is from about 200 to about 500 cubic feet per minute per square foot.

4. The method of claim 1 wherein the air permeability of the second dry end transfer fabric is from about 300 to about 400 cubic feet per minute per square foot.

5. A method for making an uncreped throughdried tissue comprising depositing an aqueous suspension of papermaking fibers onto a forming fabric to form a wet web, transferring thewet web to a throughdrying fabric, throughdrying the web to form a tissue sheet, and transferring the tissue sheet to a reel such that the sheet does not traverse an open draw while being wound onto the reel in the winding nip formed between the reel and a reel drum wherein the tissue sheet is: (a) transferred from the throughdrying fabric to a first dry end transfer fabric using a vacuum roll; (b) carried between the first dry end transfer fabric and the top side of a second dry end transfer fabric, the underside of which partially wraps around the reel drum; (c) transferred to the top side the second dry end transfer fabric; and (d) wound onto the reel.

6. The method of claim 5 wherein the air permeability of the second dry end transfer fabric is about 100 cubic feet per minute per square foot or less.

7. The method of claim 5 wherein the air permeability of the second dry end transfer fabric is from about 25 to about 100 cubic feet per minute per square foot.

8. The method of claim 5 wherein the air permeability of the second dry end transfer fabric is from about 50 to about 100 cubic feet per minute per square foot.

9. A method for making an uncreped throughdried tissue comprising depositing an aqueous suspension of papermaking fibers onto a forming fabric to form a wet web, transferring the wet web to a throughdrying fabric, throughdrying the web to form a tissue sheet, and transferring the tissue sheet to a reel such that the sheet does not traverse an open draw while being wound onto the reel in the winding nip formed between the reel and a reel drum wherein the tissue sheet is transferred directly from the throughdrying fabric to the reel drum and wound onto the reel.

10. A method for making an uncreped throughdried tissue comprising depositing an aqueous suspension of papermaking fibers onto a forming fabric to form a wet web, transferring the wet web to a throughdrying fabric, throughdrying the web to form a tissue sheet, and transferring the tissue sheet to a reel such that the sheet does not traverse an open draw while being wound onto the reel in the winding nip formed between the reel and a reel drum wherein the tissue sheet is transferred directly from the throughdrying fabric to a first reel drum, thereafter immediately transferred to a second reel drum and wound onto the reel.

11. The method of claim 1, 5, 9 or 10 wherein the speed of the tissue sheet is about 2000 feet per minute or greater.

12. The method of claim 1, 5, 9 or 10 wherein the speed of the tissue sheet is about 3000 feet per minute or greater.

* * * * *